US006339925B1

(12) United States Patent
Hung et al.

(10) Patent No.: US 6,339,925 B1
(45) Date of Patent: Jan. 22, 2002

(54) HYBRID CATALYTIC COMBUSTOR

(75) Inventors: Stephen Lan-Sun Hung, Waterford, NY (US); Jeffery Alan Lovett, Jupiter, FL (US); Kenneth Winston Beebe, Galway, NY (US); Martin Bernard Cutrone, Cape Coral, FL (US); Sanjay Marc Correa, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/184,684

(22) Filed: Nov. 2, 1998

(51) Int. Cl.[7] ..... F02C 7/228; F23R 3/40

(52) U.S. Cl. ..... 60/39.06; 60/723; 60/737; 431/7

(58) Field of Search ..... 60/39.06, 723, 60/737, 746, 747; 431/7

(56) References Cited

U.S. PATENT DOCUMENTS

| | | | | | |
|---|---|---|---|---|---|
| 4,040,252 | A | * | 8/1977 | Mosier et al. | 60/39.36 |
| 4,047,877 | A | * | 9/1977 | Flanagan | 60/723 |
| 4,118,171 | A | * | 10/1978 | Flanagan et al. | 60/723 |
| 4,432,207 | A | * | 2/1984 | Davis, Jr. et al. | 60/723 |
| 4,433,540 | A | * | 2/1984 | Cornelius et al. | 60/723 |
| 5,000,004 | A | * | 3/1991 | Yamanaka et al. | 60/723 |
| 5,431,017 | A | * | 7/1995 | Kobayashi et al. | 60/723 |
| 5,452,574 | A | * | 9/1995 | Cowell et al. | 60/39.23 |
| 5,623,819 | A | * | 4/1997 | Bowker et al. | 60/723 |
| 5,626,017 | A | * | 5/1997 | Sattelmayer | 60/723 |
| 6,070,410 | A | * | 6/2000 | Dean | 60/737 |
| 6,073,436 | A | * | 6/2000 | Bell et al. | 60/39.094 |

FOREIGN PATENT DOCUMENTS

| | | | | |
|---|---|---|---|---|
| JP | 58-108332 | * | 6/1983 | 60/723 |

OTHER PUBLICATIONS

"Development of a Gas Turbine Catalytic Combustor," T. Yoshina et al.

"Hybrid Catalytic Combustion for Stationary Gas Turbine—Concept and Small Scale Test Results," presented at the Bas Turbine Conference and Exhibition, Anaheim California, May 31–Jun. 4, 1987. Paper printed by ASME.

"A Review of NOx Formation Under Gas–Turbine Combustion Conditions," S.M. Correa. Combust. Sci. and Tech., 1992, vol. 87, pp. 329–362. Gordon and Breach Science Publishers S.A. Printed in United Kingdom.

"Design and Testing of Low NOx Catalytic Combustor for Gas Turbine," Y. Ozawa et al. 91–Yokohama–IGTC–pp. 197–204. Presented at 1991 Yokohama International Gas Turbine Congress from Oct. 27 to Nov. 1, 1991.

* cited by examiner

*Primary Examiner*—Ted Kim
(74) *Attorney, Agent, or Firm*—Patrick K. Patnode; Christian G. Cabou

(57) ABSTRACT

A hybrid combustor, for providing stable high and low levels of operation while minimizing emissions of NOx, CO, and UHCs, includes a casing having a chamber, a catalytic combustor disposed in the chamber, and a non-premixed combustor disposed in the chamber. The hybrid combustor may comprise a fuel nozzle comprising a casing having a chamber, and a body supportable in the chamber to define a passageway between the body and the casing. The passageway has an inlet for receiving a stream of air and an outlet for discharging a stream of fuel and air, and the body includes a tapering downstream portion. Desirably, flow separation of the fuel and air mixture from the body (i.e., recirculation of the fuel and air mixture in the passageway and/or chamber) is inhibited whereby a generally uniform fuel and air mixture is provided.

20 Claims, 7 Drawing Sheets

| Air Splits | | CATALYTIC PATH | | PREMIXED PATH 0% AIR LEAK | | PREMIXED PATH 3% AIR LEAK DOWNSTREAM OF FLAME, UPSTREAM OF T3.9 | | PREMIXED PATH 10% AIR LEAK DOWNSTREAM OF FLAME, UPSTREAM OF T3.9 | |
|---|---|---|---|---|---|---|---|---|---|
| AIR TO CAT-ALYTIC REACTOR | AIR TO PRE--MIXED BURNER | f/a CAT-ALYTIC TO GIVE TAD | TAD FROM CAT-ALYTIC | f/a PRE-MIXED BURNER | TAD FROM PREMIXED BURNER | f/a TO PREMIXED BURNER | TAD FROM PREMIXED BURNER | f/a TO PREMIXED BURNER | TAD FROM PREMIXED BURNER |
| 100% | 0% | 0.0292 | 2700°F | NA | NA | NO PREMIXED BURNER, BUT,CATALVST WILL RUN AT 2750™F, f/a 0.03010 | | NO PREMIXED BURNER, BUT,CATALVST WILL RUN AT 2750™F, f/a 0.03010 | |
| 90% | 10% | 0.0292 | 2700°F | 0.02920 | 2700°F | 0.0382 | 3180°F | 0.0616 | 3977°F |
| | | 0.0275 | 2600°F | 0.04450 | 3483°F | 0.0535 | 3849°F | - | - |
| | | 0.0257 | 2500°F | 0.06070 | 3984°F | - | - | - | - |
| 80% | 20% | 0.0292 | 2700°F | 0.02920 | 2700°F | 0.0337 | 2946°F | 0.0454 | 3524°F |
| | | 0.0275 | 2600°F | 0.03600 | 3067°F | 0.0405 | 3294°F | 0.0522 | 3804°F |
| | | 0.0257 | 2500°F | 0.04320 | 3423°F | 0.0477 | 3625°F | 0.0594 | 3984°F |
| | | 0.0240 | 2400F° | 0.05000 | 3719°F | 0.0545 | 3882°F | - | - |
| | | 0.0224 | 2300°F | 0.05640 | 3935°F | - | - | - | - |
| 70% | 30% | 0.0292 | 2700°F | 0.02920 | 2700°F | 0.03220 | 2865°F | 0.04000 | 3269°F |
| | | 0.0275 | 2600°F | 0.03317 | 2918°F | 0.03617 | 3076°F | 0.04397 | 3459°F |
| | | 0.0257 | 2500°F | 0.03737 | 3138°F | 0.04037 | 3288°F | 0.04817 | 3644°F |
| | | 0.0240 | 2400°F | 0.04133 | 3334°F | 0.04433 | 3475°F | 0.05213 | 3801°F |
| | | 0.0224 | 2300°F | 0.04507 | 3509°F | 0.04807 | 3640°F | 0.05587 | 3922°F |
| | | 0.0207 | 2200°F | 0.04903 | 3680°F | 0.05203 | 3797°F | 0.05983 | 3986°F |
| | | 0.0191 | 2100°F | 0.05277 | 3824°F | 0.05577 | 3919°F | - | - |
| 60% | 40% | 0.0292 | 2700°F | 0.02920 | 2700°F | 0.03145 | 2824°F | 0.03730 | 3134°F |
| | | 0.0275 | 2600°F | 0.03175 | 2841°F | 0.03400 | 2962°F | 0.03985 | 3262°F |
| | | 0.0257 | 2500°F | 0.03445 | 2986°F | 0.03670 | 3103°F | 0.04255 | 3392°F |
| | | 0.0240 | 2400°F | 0.03700 | 3119°F | 0.03925 | 3232°F | 0.04510 | 3510°F |
| | | 0.0224 | 2300°F | 0.03940 | 3240°F | 0.04165 | 3350°F | 0.04750 | 3616°F |
| | | 0.0207 | 2200°F | 0.04195 | 3364°F | 0.04420 | 3469°F | 0.05005 | 3721°F |
| | | 0.0191 | 2100°F | 0.04435 | 3476°F | 0.04660 | 3577°F | 0.05245 | 3813°F |
| 50% | 50% | 0.0292 | 2700°F | 0.02920 | 2700°F | 0.03100 | 2800°F | 0.03568 | 3050°F |
| | | 0.0275 | 2600°F | 0.03090 | 2794°F | 0.03270 | 2892°F | 0.03738 | 3138°F |
| | | 0.0257 | 2500°F | 0.03270 | 2892°F | 0.03450 | 2988°F | 0.03918 | 3229°F |
| | | 0.0240 | 2400°F | 0.03440 | 2983°F | 0.03620 | 3077°F | 0.04088 | 3312°F |
| | | 0.0224 | 2300°F | 0.03600 | 3067°F | 0.03780 | 3160°F | 0.04248 | 3389°F |
| | | 0.0207 | 2200°F | 0.03770 | 3154°F | 0.03950 | 3245°F | 0.04418 | 3468°F |
| | | 0.0191 | 2100°F | 0.03930 | 3235°F | 0.04110 | 3323°F | 0.04578 | 3541°F |

FIG. 3A

| Air Splits | | CATALYTIC PATH 0% AIR LEAK | | PREMIXED PATH 0% AIR LEAK | | PREMIXED PATH 3% AIR LEAK DOWNSTREAM OF FLAME, UPSTREAM OF T3.9 | | PREMIXED PATH 10% AIR LEAK DOWNSTREAM OF FLAME, UPSTREAM OF T3.9 | |
|---|---|---|---|---|---|---|---|---|---|
| AIR TO CAT-ALYTIC REACTOR | AIR TO PRE-MIXED BURNER | f/a CAT-ALYTIC TO GIVE TAD | TAD FROM CAT-ALYTIC | f/a PRE-MIXED BURNER | TAD FROM PREMIXED BURNER | f/a PRE-MIXED BURNER | TAD FROM PREMIXED BURNER | f/a PRE-MIXED BURNER | TAD FROM PREMIXED BURNER |
| 40% | 60% | 0.0292 | 2700°F | 0.02920 | 2700°F | 0.03070 | 2783°F | 0.03460 | 2994°F |
| | | 0.0275 | 2600°F | 0.03033 | 2762°F | 0.03183 | 2845°F | 0.03573 | 3053°F |
| | | 0.0257 | 2500°F | 0.03153 | 2829°F | 0.03303 | 2910°F | 0.03693 | 3115°F |
| | | 0.0240 | 2400F° | 0.03267 | 2891°F | 0.03417 | 2971°F | 0.03807 | 3173°F |
| | | 0.0224 | 2300F° | 0.03373 | 2948°F | 0.03523 | 3027°F | 0.03913 | 3226°F |
| | | 0.0207 | 2200F° | 0.03487 | 3008°F | 0.03637 | 3086°F | 0.04027 | 3283°F |
| | | 0.0191 | 2100F° | 0.03593 | 3064°F | 0.03743 | 3141°F | 0.04133 | 3334°F |
| 30% | 70% | 0.0292 | 2700°F | 0.02920 | 2700°F | 0.03049 | 2771°F | 0.03383 | 2953°F |
| | | 0.0275 | 2600°F | 0.02933 | 2918°F | 0.03121 | 2811°F | 0.03456 | 2992°F |
| | | 0.0257 | 2500°F | 0.03070 | 3138°F | 0.03199 | 2845°F | 0.03533 | 3032°F |
| | | 0.0240 | 2400°F | 0.03143 | 3334°F | 0.03271 | 2893°F | 0.03606 | 3070°F |
| | | 0.0224 | 2300°F | 0.03211 | 3509°F | 0.03340 | 2930°F | 0.03674 | 3105°F |
| | | 0.0207 | 2200°F | 0.03284 | 3680°F | 0.03413 | 2969°F | 0.03747 | 3143°F |
| | | 0.0191 | 2100°F | 0.03353 | 3824°F | 0.03481 | 3005°F | 0.03816 | 3178°F |
| 20% | 80% | 0.0292 | 2700°F | 0.02920 | 2700°F | 0.03033 | 2762°F | 0.03325 | 2922°F |
| | | 0.0275 | 2600°F | 0.02963 | 2740°F | 0.03075 | 2786°F | 0.03368 | 2945°F |
| | | 0.0257 | 2500°F | 0.03008 | 2783°F | 0.03120 | 2810°F | 0.03413 | 2969°F |
| | | 0.0240 | 2400°F | 0.03050 | 2823°F | 0.03163 | 2834°F | 0.03455 | 2991°F |
| | | 0.0224 | 2300°F | 0.03090 | 2860°F | 0.03203 | 2856°F | 0.03495 | 3012°F |
| | | 0.0207 | 2200°F | 0.03133 | 2900°F | 0.03245 | 2879°F | 0.03538 | 3035°F |
| | | 0.0191 | 2100°F | 0.02840 | 2937°F | 0.03285 | 2900°F | 0.03578 | 3056°F |
| 10% | 90% | 0.0292 | 2700°F | 0.02920 | 2700°F | 0.03020 | 2755°F | 0.03280 | 2898°F |
| | | 0.0275 | 2600°F | 0.02939 | 2710°F | 0.03039 | 2766°F | 0.03299 | 2908°F |
| | | 0.0257 | 2500°F | 0.02959 | 2721°F | 0.03059 | 2777°F | 0.03319 | 2919°F |
| | | 0.0240 | 2400°F | 0.02978 | 2732°F | 0.03078 | 2787°F | 0.03338 | 2929°F |
| | | 0.0224 | 2300°F | 0.02996 | 2742°F | 0.03096 | 2797°F | 0.03356 | 2938°F |
| | | 0.0207 | 2200°F | 0.03014 | 2752°F | 0.03114 | 2807°F | 0.03374 | 2948°F |
| | | 0.0191 | 2100°F | 0.03032 | 2762°F | 0.03132 | 2817°F | 0.03392 | 2958°F |

FIG. 3B

HYBRID CATALYTIC COMBUSTOR

BACKGROUND OF THE INVENTION

This invention relates to combustors, and more specifically, to hybrid combustors for providing a substantially uniform fuel and air mixture.

Combustors for gas turbines typically comprise a combustion chamber together with burners, igniters, and fuel injection devices. Combustors for gas turbines have traditionally operated in a non-premixed mode in which a fuel (e.g., natural gas) and an oxidant (e.g., air) are completely separated as the reactants enter the flame. In general, non-premixed combustors are stable over a wide range of operating conditions and at low fuel-air ratios. A drawback of non-premixed combustors, however, is that high temperatures in the reaction zone lead to increased production of nitrogen oxides (NOx).

In premixed combustors, the fuel and the oxidant are completely premixed before combustion. The production of NOx in premixed flames is minimized because localized high temperatures in the reaction zone are avoided. A drawback of premixed combustors is that at low loads, premixed combustors produce higher levels of carbon monoxide (CO) and unburned hydrocarbons (UHCs) and are also not as stable compared to non-premixed combustors. Although the flame stability in premixed combustors can be improved through mechanical and aerodynamic means (e.g., fuel nozzles having a bluff body with a broad flattened surface for causing recirculation of the flow of the fuel and air mixture having swirlers), premixed combustors generally lack the stability of non-premixed combustors.

An approach for stabilizing premixed combustors is the application of a catalyst in the combustor to initiate and promote gas phase combustion, which combustion has been referred to sometimes as "catalytic combustion", catalytically stabilized combustion, or "catalytically stabilized thermal combustion." A drawback of catalytic combustors is that their maximum operating temperature may be limited by the thermal stability of the catalytic materials or the mechanical supports. Another drawback is that non-uniformities in the fuel-air mixture, for example, from a fuel nozzle, result in areas of localized overheating if the fuel-air mixture is too rich, or areas of low catalyst activity if the fuel-air mixture is too lean.

Therefore, there is a need for hybrid combustors which provide stable high and low levels of operation while minimizing emissions of NOx at high levels of operation and minimizing emissions of CO or UHCs at low levels of operation. In addition, there is a need for fuel nozzles for providing a substantially uniform fuel and air mixture.

SUMMARY OF THE INVENTION

A hybrid combustor, for providing stable high and low levels of operation while minimizing emissions of NOx, CO, and UHCs, includes a casing having a chamber, a catalytic combustor disposed in the chamber, and a non-premixed combustor disposed in the chamber. The hybrid combustor may comprise a fuel nozzle comprising a casing having a chamber, and a body supportable in the chamber to define a passageway between the body and the casing. The passageway has an inlet for receiving a stream of air and an outlet for discharging a stream of fuel and air, and the body includes a tapering downstream portion. Desirably, flow separation of the fuel and air mixture from the body (i.e., recirculation of the fuel and air mixture in the passageway or chamber) is inhibited whereby a generally uniform fuel and air mixture is provided.

BRIEF DESCRIPTION OF THE DRAWINGS

FIGS. 3A and 3B are tables of the results of adiabatic flame temperature for catalytic versus premixed burner paths for various fuelair ratios at 0 percent, 3 percent, and 10 percent air leak around the flame;

DETAILED DESCRIPTION OF THE INVENTION

Figure 1:
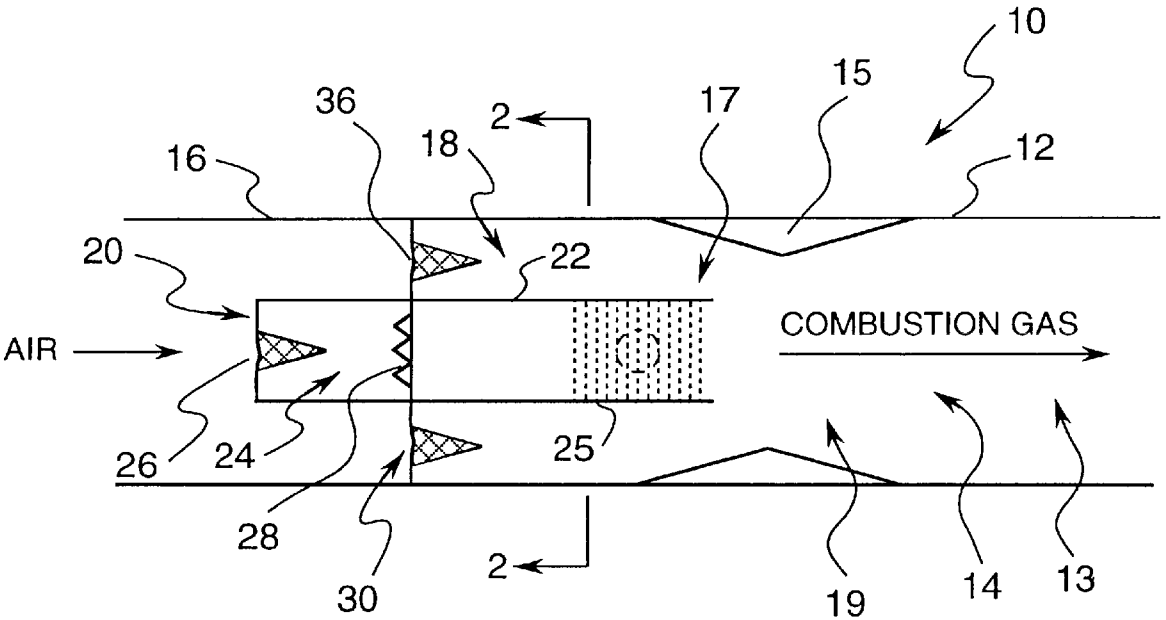
FIG. 1 is a diagrammatic sectional view of a hybrid combustor of the present invention.

FIG. 1 diagrammatically illustrates one embodiment of a hybrid catalytically stabilized dry low NOx combustor 10 that may be used in, for example, a gas turbine (not shown). Hybrid combustor 10 provides stable high and low levels of operation while minimizing emissions of NOx, CO, and UHCs. In this exemplary embodiment, a catalytic combustor 20 is arranged substantially to run in parallel and substantially simultaneously with a non-premixed (e.g., diffusion flame) combustor 30.

Hybrid combustor 10 may be configured to include a generally cylindrically-shaped casing 12 having a chamber 14 therein in which generally cylindrically-shaped catalytic combustor 20 is centrally disposed in chamber 14 and non-premixed combustor 30 is disposed between casing 12 and catalytic combustor 20.

Catalytic combustor 20 may include a generally elongated, cylindrically-shaped casing or liner 22 having a chamber 24 therein. A preburner 26 is disposed adjacent to an upstream end of liner 22, a catalytic reactor 25 is disposed adjacent to a downstream end of liner 22, and one or more fuel injectors 28 are disposed in chamber 24 between preburner 26 and catalytic reactor 25. Preburner 26 provides heat to initiate the catalytic process in catalytic reactor 25. In addition, preburner 26 provides an additional means for producing heat and combustion gases in hybrid combustor 10 to allow hybrid combustor 10 to achieve various load targets with or without operation of catalytic reactor 25. Furthermore, preburner 26 may comprise a non-premixed preburner burner or a premixed preburner burner.

Figure 2:
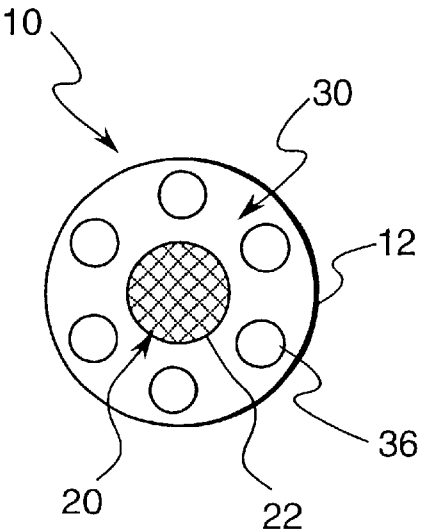
FIG. 2 is a cross-sectional view taken along line 2—2 of FIG. 1.

In this exemplary embodiment, as shown in FIGS. 1 and 2, non-premixed combustor 30 is desirably disposed in an annulus formed between casing 12 and catalytic combustor 20 and is spaced-apart and concentrically disposed between casing 12 and liner 22 of catalytic combustor 20. Although FIG. 2 illustrates an arrangement of six non-premixed burners 36, any number of non-premixed burners may be used. Non-premixed combustor 30 may further comprise a plurality of non-premixed burners or a combination of non-premixed and premixed burners. In addition, the axial positions of non-premixed combustors 30 relative to catalytic combustor 20 may also be varied.

With reference to FIG. 1 again, in the operation of hybrid combustor 10, a stream or supply of air is provided to an upstream end of casing 12. A first portion of the stream or supply of air is provided to catalytic combustor 20 by being introduced through an upstream portion of liner 22 or through the wall forming the upstream portion of liner 22. Fuel injectors 28 are positioned downstream of preburner 22 for introducing a stream or supply of fuel into the stream of air in catalytic combustor 20. Once fuel is injected into the stream of air, the premixed fuel-air mixture then passes through catalytic reactor 25 which oxidizes the fuel-air mixture. In some configurations, gas phase combustion of the hot gases from the catalytic reactor may continue downstream of catalyst reactor 25.

A second portion of the stream or supply of air and a second supply of fuel are provided to non-premixed burners 36 for combustion between casing 12 and liner 22 of catalytic combustor 20.

Hybrid combustor 10 may also be operated in an alternative mode to promote gas phase combustion from a generally parallel premixed fuel-air mixture from non-premixed burners 36. For example, instead of using non-premixed burners 36 to burn a supply of fuel, non-premixed burners 36 may provide a stream of premixed fuel and air that is passed through the annulus between casing 12 and catalytic combustor 20 for combustion downstream of catalytic combustor 20. For example, the flames produced by non-premixed burners 36 may be extinguished by shutting off the supply of fuel, followed by re-introduction of the fuel through a nozzle of burner 36 without ignition. Air required for the premixed fuel-air mixture can continue to pass through either the annulus between casing 12 and catalytic combustor 20, or through a porous upstream portion 16 of casing 12.

In operation in this alternative mode, the unburned fuel-air mixture exits a mixing region 17 so that the unburned fuel-air mixture can then mix with the hot effluent gases in a downstream region 19 from catalytic combustor 20. Desirably, through a combination of thermal and chemical interactions between the hot effluent gases from catalytic combustor 20 and the premixed fuel-air mixture, the premixed fuel-air mixture can be ignited and burned in region 19 downstream of catalytic reactor 25 and between a downstream portion of a venturi 15 disposed in chamber 14.

Venturi 15 not only helps stabilize gas phase combustion by acting as a bluff body and creating a recirculation region, but Venturi 15 also increases local gas velocities at the exit of the mixing region 17 to prevent flashback of the flame into the fuel-air premixing region 18. For hybrid combustor 10 shown in FIG. 1, completion of gas phase combustion might also occur further downstream in the combustor, for example, in region 13.

From the present description, it will be appreciated by those skilled in the art that separate means, for example, one or more ports or fuel injectors, for introducing a supply of fuel to the second portion of the supply of air may be provided in addition to non-premixed combustor 30 having a plurality of non-premixed burners 36. In addition, it will be appreciated that the venturi may have other configurations, for example, curved surfaces, as well as other types of bluff bodies may be positioned in chamber 14 for stabilizing a flame in chamber 14. Furthermore, depending on the particular application, it may also be advantageous to introduce additional air at various locations through the downstream portion of casing 12.

The amount of NOx produced by hybrid combustor 10 is dependent upon a number of conditions, which conditions may include the type of fuel used, the temperature profile of the flame, the operation pressure, and the gas residence time in the combustor. Furthermore, the design and operation of hybrid combustor 10 are a compromise between the desire to run catalytic combustor 20 at a low temperature to extend the life of catalytic materials and mechanical supports versus the need to prevent non-premixed combustor 30 from operating at excessive temperatures wherein high rates of NOx emissions are produced.

By using and combining existing data from independent tests of a catalytic combustor and from a premixed combustor, it is possible to estimate the amount of NOx that may be produced from a hybrid combustor that combines, in parallel, the use of these two different combustors. This tradeoff can be characterized by examining, 1) the variations in the air split between the catalytic path and the premixed path, and also, 2) the variations in the fuel-air ratios to the two paths.

FIGS. 3A and 3B illustrate a table showing the fuel-air ratios and their associated adiabatic flame temperatures for various air splits and fuel-air ratios for the catalytic path versus the premixed paths. These calculations were made by assuming a combustor pressure of about 15 atmospheres, an inlet air temperature of about 735 degrees Fahrenheit (F.), and an inlet fuel temperature of about 70 degrees F. With methane as the fuel, the adiabatic flame temperatures were estimated at the various fuel-air ratios using NASA CET89 thermodynamic code.

The calculations were made to achieve a final combustor exit temperature of about 2700 degrees F. with the final combustor temperature being an average mixture temperature for the gases from the catalytic and premixed paths. Accordingly, as the adiabatic flame temperature of the fuel-air mixture to the catalytic path is reduced (i.e., below 2700 degrees F.), the adiabatic flame temperature through the premixed path must be increased (i.e., greater than 2700 degrees F.) in order to achieve the same final desired mixture temperature of 2700 degrees F.

Observable from FIGS. 3A and 3B is that as the fraction of air to the catalytic combustor is reduced, less of an increase in fuel-air ratio from the premixed path is required to offset a decrease in fuel-air ratio from the catalytic paths. Using the tabulation of adiabatic flame temperatures in FIGS. 3A and 3B, an estimate of the total amount of NOx produced from the combined catalytic and premixed streams may be made by adding together the amount of NOx expected (from readily available data) from each of the two combustion paths.

The same calculations were also repeated by assuming 3 percent and 10 percent leakage of the total air into the hot gas flow path between the flame and the combustor exit, and are also illustrated in FIGS. 3A and 3B. Air leaks between the flame and combustor exit can be caused by leak paths in the seals between various combustor components which are not uncommon in commercial gas turbine combustors. Note that if an air leak exits between the flame and the combustor exit, the flame must fire at even higher temperatures to achieve a final temperature of 2700 degrees F. since the air leak will reduce the mixture temperature. For an example, it was estimated that with a 3 percent air leak, the mixture gas temperature before the leak must be 2750 degrees F. to give a final average temperature of 2700 degrees F. If the air leak were 10 percent, the mixture gas temperature before the leak must be 2878 degrees F. to give the same 2700 degrees F. average temperature. The calculations which include air leaks give a more realistic representation of temperatures which might be found in commercial gas turbine combustors.

Figure 5:
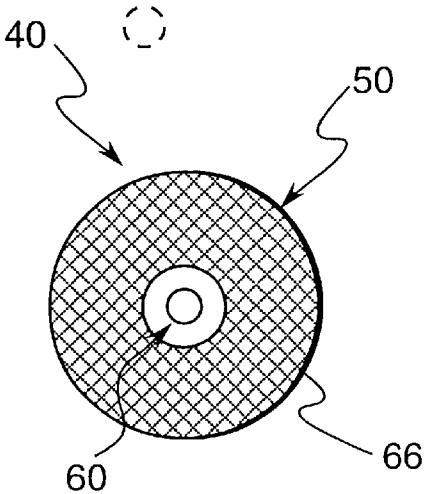
FIG. 5 is a cross-sectional view taken along line 5—5 of FIG. 4.
Figure 4:
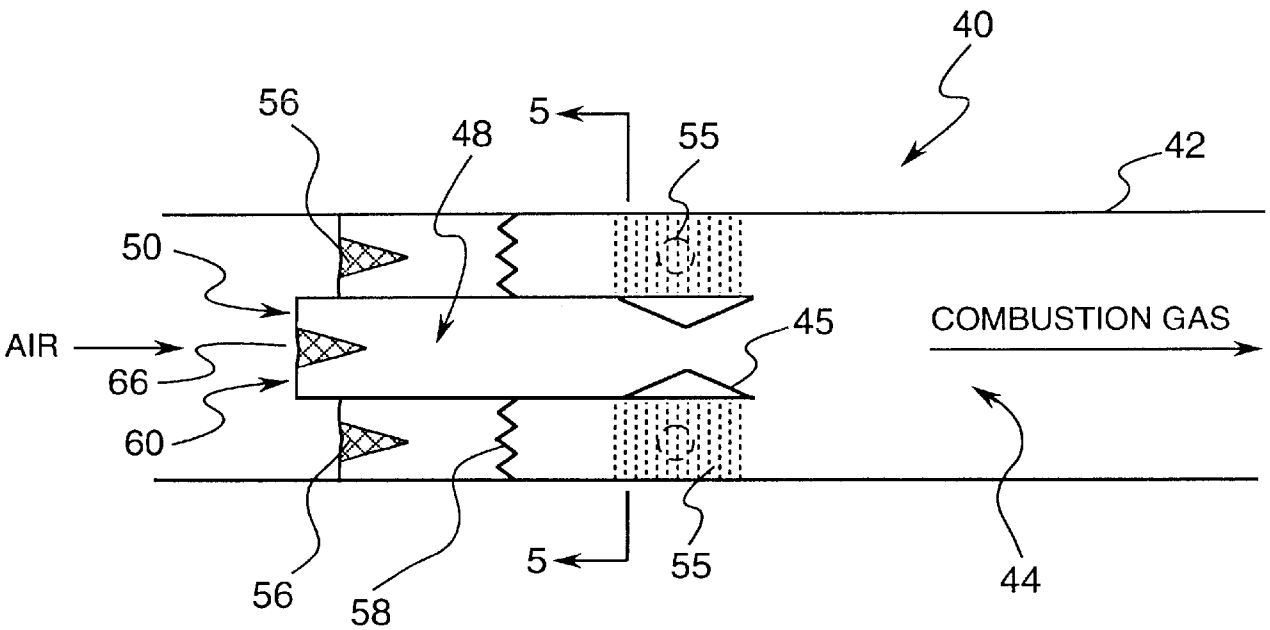
FIG. 4 is a diagrammatic sectional view of an alternative embodiment of a hybrid combustor of the present invention.
Figure 7:
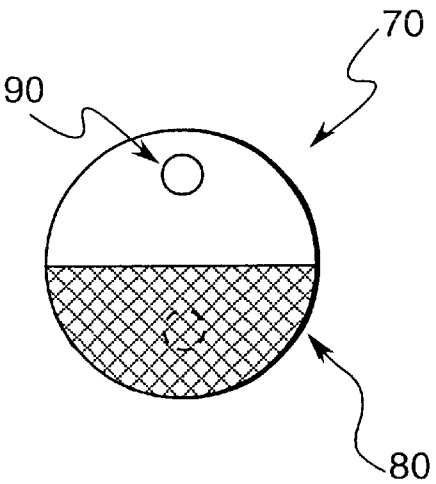
FIG. 7 is a cross-sectional view taken along line 7—7 of FIG. 6.
Figure 6:
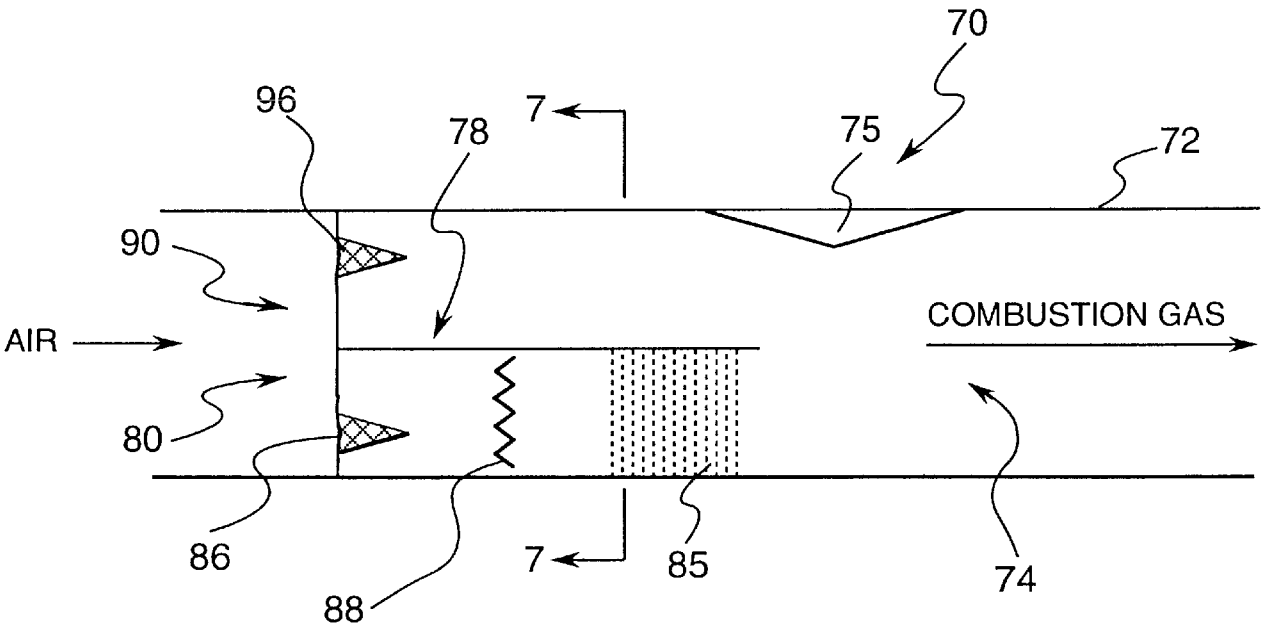
FIG. 6 is a diagrammatic sectional view of an alternative embodiment of a hybrid combustor of the present invention.

FIGS. 4–7 show two alternative embodiments for hybrid combustors. FIGS. 4 and 5 illustrate a hybrid combustor 40 in which a non-premixed combustor 60 is centered within and surrounded by a catalytic combustor 50. A plurality of preburners 56 are disposed adjacent to an upstream end of catalytic combustor 50, a catalytic reactor 55 is disposed adjacent to a downstream end of catalytic combustor 50, and a plurality of fuel injectors 58 are disposed between preburners 56 and catalytic reactor 55. Non-premixed combustor 60 comprises a non-premixed burner 66 that may also be transitioned to provide a stream of premixed fuel and air. Desirably, a venturi 45 is provided at the downstream portion of non-premixed combustor 60 to prevent flash back of the flame into the fuel-air premixing region 48. FIGS. 6 and 7 illustrate a hybrid combustor 70 in which catalytic combustor 80 and a non-premixed combustor 90 each occupy half of a cylindrically-shaped casing 72. A preburner 86 is disposed adjacent to an upstream end of catalytic combustor 80, a catalytic reactor 85 is disposed adjacent to a downstream end of catalytic combustor 80, and a plurality of fuel injectors 88 are disposed between preburner 86 and catalytic reactor 85. Non-premixed combustor 90 comprises a non-premixed burner 96 that may also be transitioned to provide a stream of premixed fuel and air. Desirably a venturi 75 is provided at the downstream portion of non-premixed combustor 90 to prevent flash back of the flame into fuel-air premixing region 78. From the present description, it will be appreciated by those skilled in the art that other generally parallel configurations of a catalytic combustor and a non-premixed combustor may be employed.

Figure 8:
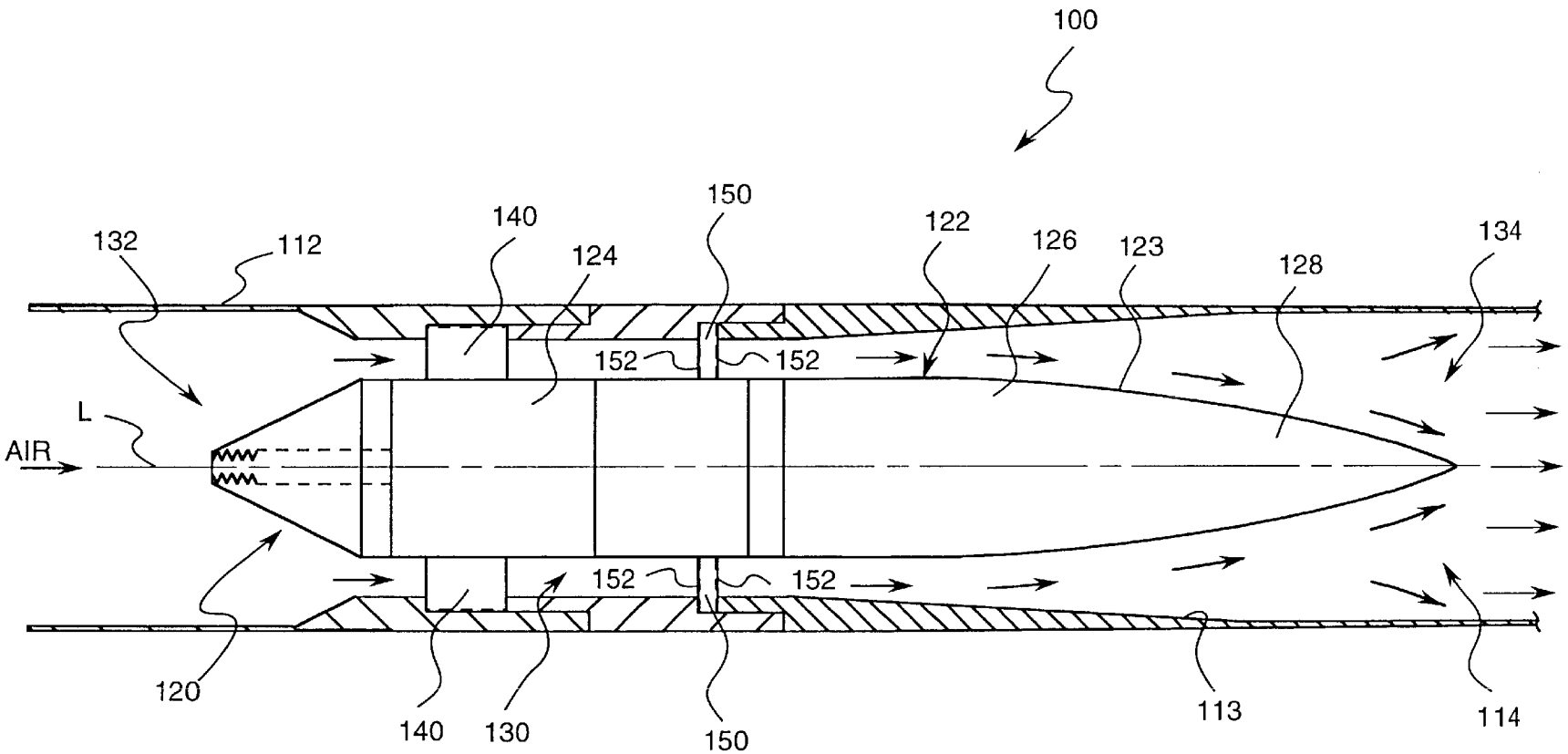
FIG. 8 is a side elevation view, in part section, of a fuel nozzle of the present invention.

FIG. 8 illustrates one embodiment of a fuel nozzle 100 for providing a generally spatially uniform fuel and air mixture (e.g., having a uniform distribution concentration of fuel and air) to a catalytic combustor in, for example, a gas turbine, and in particular for fuel injectors 28 shown in FIG. 1, fuel injectors 58 shown in FIG. 4, and fuel injectors 88 shown in FIG. 6.

In this illustrated embodiment, fuel nozzle 100 includes a cylindrical outer casing 112 having a chamber 114 and a longitudinal axis L. A hub or body 120 is supported in casing 112 so that body 120 and casing 112 define an air flow path or passageway 130 therebetween. Passageway 130 includes an inlet 132 for receiving a stream or supply of air and an outlet 134 for discharging a stream or supply of fuel and air. Body 120 includes a tapered downstream portion 122 so that the cross-sectional area of passageway 130 increases when moving towards outlet 134.

Body 120 may be supported and positioned in the center of the air flow path in a casing 112 by a plurality of struts 140 (only two of which are shown in FIG. 8). Fuel is supplied to the forward portion of body 120 and distributed into the air flow path by a plurality of apertures 152 in a plurality of fuel spokes or injectors 150, which injectors 150 extend between casing 112 and body 120.

In this illustrated embodiment, tapered downstream portion 122 of body 120 transitions from a cylindrical-shaped cross-sectional portion 124 to an ellipsoid-shaped cross-sectional portion 126, and then to a conically-shaped cross-sectional portion 128 that terminates at a point 129. This configuration minimizes flow separation of the fuel and air mixture from the surface of body 120 (i.e. recirculation of the fuel and air mixture). Desirably, a downstream inner surface 113 of casing 112 also diverges, slopes, or expands outwardly at an angle of about 3.5 degrees or less so that the cross-sectional area of passageway 114 further increases when moving towards outlet 134 while minimizing flow separation of the fuel and air mixture from inner surface 113.

During operation, fuel nozzle 120 first reduces the cross-sectional flow area of the supply of air to a narrow annular region where fuel, for example, gas, is injected into the air flow. Then, the flow path is expanded through a diffuser section defined by sloped sides 113 of casing 112 and tapered downstream portion 122 of body 120.

The geometry of fuel nozzle 100 minimizes flow separation in order to minimize the likelihood of recirculation of the fuel and air mixture, which recirculation would lead to a nonuniform fuel and air mixture, as well as the possibility that a gas phase flame could be anchored in the wake of fuel nozzle 100. In addition, the overall geometry of fuel nozzle 100 desirably reduces the pressure losses to the air flow between the upstream end and the downstream end.

An experimental eight-inch fuel nozzle has been built and tested under fired and unfired conditions. The concentration of fuel and air from the fuel nozzle was first measured prior to firing of a preburner which was positioned upstream of the nozzle. The test operated at combustion air flowrate of 7 pounds/second, air preheat temperature of about 575 to 600 degrees F. (about 302 to 316 degrees C.), and combustor pressure of 7 atm. A diametrically traversing gas sampling probe was used to measure the fuel concentration profiles at the catalytic reactor inlet (i.e., downstream from the fuel nozzle).

Figure 9:
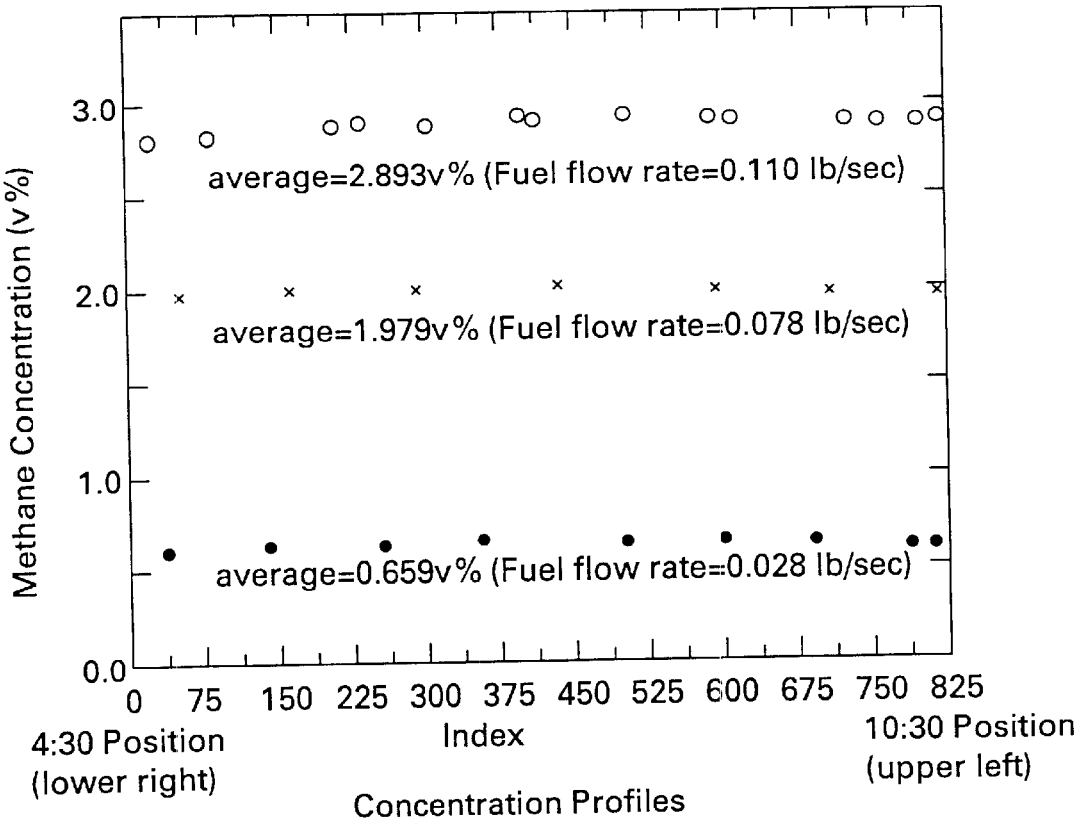
FIG. 9 is a graph of a concentration profile of three fuel-air ratios measured diametrically across the downstream end of the fuel nozzle shown in FIG. 8.

Initially, the diametrically traversing probe was positioned to scan the direction from a 10:30 position (top left) to a 4:30 position (lower right, looking downstream). Without firing the preburner, three fuel flowrates of 0.028, 0.078, and 0.110 lb./sec. were used, corresponding to fuel-air ratios of 0.004, 0.011, and 0.016 lb./lb., respectively. The results of these measurement are shown in FIG. 9 and illustrate a generally uniform and constant fuel concentration across the diameter of chamber 114 for each of these three fuel flowrates.

The fuel nozzle was exposed to the operational thermal cycles of the preburner to determine if the nozzle was operable to withstand thermal stresses under actual test conditions. The preburner was ignited and cycled from about 650 degrees F. to 1100 degrees F. (about 343 degrees C. to 593 degrees C.) at a rate of about 25 degrees F./min (about 14 degrees C./min). After two thermal cycles of the preburner, a fuel concentration traverse was made at a fuel flowrate of 0.110 lb./sec. and compared to the concentration profile measured prior to the preburner cycles. No measurable changes in fuel uniformity were observed following the preburner cycles indicating that the fuel nozzle remained undamaged through the preburner thermal cycles and that the fuel nozzle continued to give excellent fuel concentration uniformities, i.e., a generally uniform fuel and air mixture.

The fuel nozzle has also been tested under fired catalytic combustor conditions. Thermocouple temperature measurements taken within the catalytic reactor and thermal imaging temperature measurements of the aft end of the catalytic reactor show the radial temperature profile in the reactor to be highly uniform.

Figure 10:
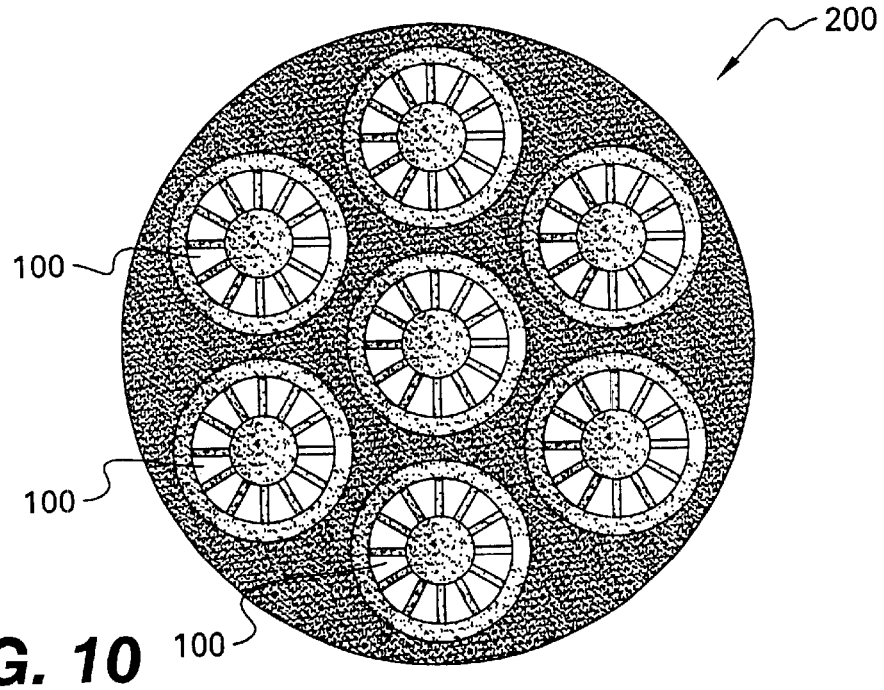
FIG. 10 is an end view of an assembly having seven fuel nozzles shown in FIG. 8.

A plurality of fuel nozzles 100 may be configured in an array or assembly 200 as shown in FIG. 10. Such an arrangement of fuel nozzles 100 may be more advantageous under some conditions, e.g., when a single fuel nozzle may be prohibitively large or long. Other configurations of an array or assembly of fuel nozzle may also be employed, for example, an array or assembly having a different number of fuel nozzles 100.

From the present description, it will be appreciated by those skilled in the art that while fuel nozzle 100 is desirable for use with catalytic combustors, fuel nozzle 100 may also be used in a premixed combustor, for example, by placing a bluff body or a V-gutter downstream from the fuel nozzle in order to anchor a flame.

While only certain features of the invention have been illustrated and described, many modifications and changes will occur to those skilled in the art. It is, therefore, to be understood that the appended claims are intended to cover all such modifications and changes as fall within the true spirit of the invention.

What is claimed is:

1. A hybrid combustor comprising:

a casing having an air inlet at one end and a chamber at an opposite end;

a first combustor disposed in said casing between said air inlet and said chamber, and including in serial flow communication in a first flowpath a preburner, a first flow duct having a fuel injector therein, and a catalytic reactor;

a second combustor disposed in said casing between said air inlet and said chamber, and including in serial flow communication in a second flowpath a burner and a second flow duct; and said first and second combustors laterally adjoin each other to position said first and second flowpaths in parallel flow between said air inlet and said chamber said first combustor further comprises a liner extending axially between said preburner and said catalytic reactor to define said first flow duct adjoining said second combustor; and said preburner is disposed at an upstream end of said liner for discharging heated combustion gases into said first flow duct for mixing with fuel from said injector wherein said second combustor surrounds said first combustor.

2. The hybrid combustor according to claim 1, wherein said first combustor surrounds said second combustor.

3. The hybrid combustor according to claim 1, wherein said first combustor is disposed within one side of said casing and said second combustor is disposed within an opposite side of said casing.

4. The hybrid combustor according to claim 1, wherein said second combustor further comprises a plurality of selectively operable non-premixed burners.

5. A method of operating said hybrid combustor according to claim 4 comprising:

combusting fuel and air into said second combustor from said burners;

extinguishing combustion from said burners in said second combustor; and fueling said burners of said second combustor without ignition therein for channeling an unburned fuel-air mixture for combustion downstream of said catalytic combustor in said chamber.

6. The hybrid combustor according to claim 1, wherein said casing further comprises a venturi disposed generally downstream from said second combustor in flow communication therewith.

7. The hybrid combustor according to claim 1, wherein said fuel infector comprises a casing having a chamber, a body disposed in said chamber to define a passageway between said body and said casing, said passageway having an inlet facing upstream toward said preburner for receiving a stream of air and an outlet facing downstream toward said catalytic reactor for discharging a stream of fuel and air, and wherein said body comprises a tapered downstream portion.

8. The hybrid combustor according to claim 9 wherein said body tapered downstream portion tapers from cylindrical to ellipsoidal to conical.

9. A hybrid combustor according to claim 7, wherein said tapered downstream portion of said body is effective to inhibit flow separation of the supply of fuel and air along said tapering downstream portion.

10. A hybrid combustor according to claim 7, wherein said body tapers generally to a point adjacent to said outlet.

11. A hybrid combustor according to claim 7, wherein said tapered downstream portion of said body comprises an ellipsoid-shaped portion.

12. A hybrid combustor according to claim 7, wherein said tapered downstream portion of said body comprises a conical-shaped portion.

13. A hybrid combustor according to claim 7, wherein the supply of air and the supply of fuel and air through said passageway flows generally parallel to a longitudinal axis of said fuel injector.

14. A hybrid combustor according to claim 7, wherein said injector casing comprises a diverging downstream inner surface.

15. A hybrid combustor according to claim 14, wherein said diverging downstream inner surface is effective to inhibit flow separation of the supply of fuel and air along said diverging downstream inner surface.

16. A hybrid combustor according to claim 7, wherein said body is supported in said chamber by a plurality of struts.

17. A hybrid combustor according to claim 7, further comprising a plurality of fuel injection apertures which span between said injector casing and said body.

18. A method for combusting a supply of fuel and air to minimize emissions of NOx, CO, and UHCS, the method comprising the steps of:

preburning a first supply of fuel and air;

injecting additional fuel into said preburned fuel and air;

catalytically combusting said preburned supply of fuel and air and injected fuel; and combusting a second supply of fuel and air channeled in parallel flow with said first supply;

wherein said step of combusting said second supply of fuel and air comprises extinguishing combustion of said second supply of fuel and air and supplying said extinguished fuel and air for combustion downstream of said catalytically combusted preburned supply of fuel and air and injected fuel.

19. The method of claim 18, wherein said step of catalytically combusting said preburned first supply of fuel and air and infected fuel, and said step of combusting said second supply of fuel and air occur substantially simultaneously.

20. A method according to claim 18 wherein said fuel injecting step comprises:

providing a passageway having an inlet, an outlet, and a generally annular cross-section, and wherein a downstream portion of said passageway gradually transitions to a circular cross-section adjacent to said outlet;

introducing a supply of air to said inlet of said passageway;

introducing a supply of fuel to said supply of air in said passageway; and discharging said fuel and air from said passageway into said preburned fuel and air.

* * * * *